United States Patent [19]

Sakamaki

[11] 3,942,920

[45] Mar. 9, 1976

[54] ROTARY FLUID PUMPS

[75] Inventor: Hiroshi Sakamaki, Utsunomiya, Japan

[73] Assignee: Nippon Piston Ring Co., Ltd., Tokyo, Japan

[22] Filed: Nov. 29, 1974

[21] Appl. No.: 528,314

[30] Foreign Application Priority Data

Nov. 28, 1973 Japan ..... 48-132568

[52] U.S. Cl. ..... 418/230

[51] Int. Cl.[2] ..... F04C 15/00

[58] Field of Search ..... 418/229–232, 418/219

[56] References Cited

UNITED STATES PATENTS

| | | | |
|---|---|---|---|
| 750,219 | 1/1904 | Von Mittler | 418/230 |
| 2,100,267 | 11/1937 | Potthast | 418/230 |
| 2,646,753 | 7/1953 | Zoll | 418/219 |
| 3,163,090 | 12/1964 | Conrad | 418/219 |
| 3,456,594 | 7/1969 | Cosby | 418/230 |
| 3,489,126 | 1/1970 | Regar | 418/232 |
| R19,783 | 12/1935 | Roberts | 418/230 |

*Primary Examiner*—William L. Freeh
*Assistant Examiner*—O. T. Sessions
*Attorney, Agent, or Firm*—Sughrue, Rothwell, Mion, Zinn & Macpeak

[57] ABSTRACT

A rotary fluid pump rotor is not eccentrically rotated relative to a casing and as a consequence an eccentric load is not loaded on the shaft and bearing. The fluid pump of the invention may use a seal ring in order to maintain fluids air-tight for effective operation.

2 Claims, 6 Drawing Figures

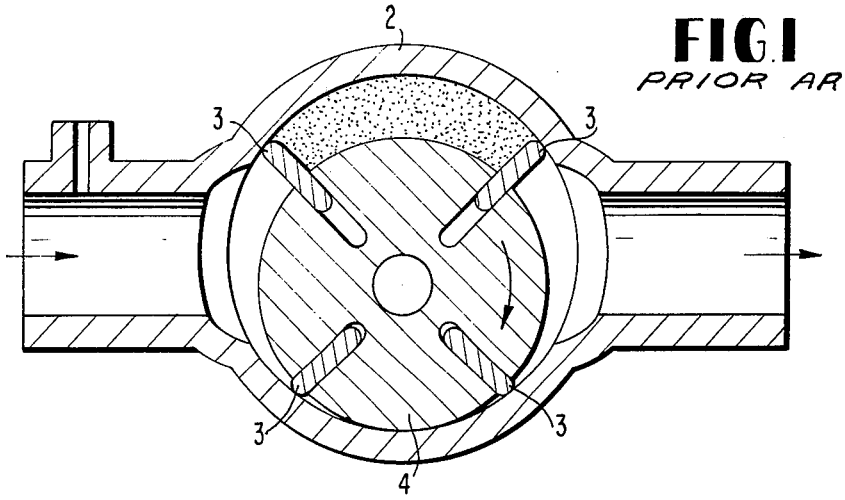
FIG. 1
PRIOR ART
FIG. 2
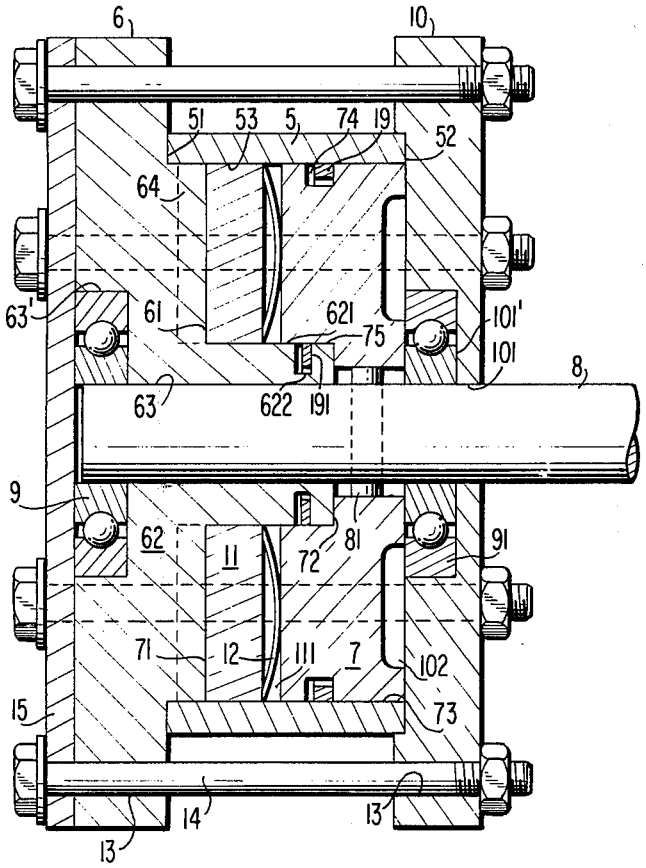

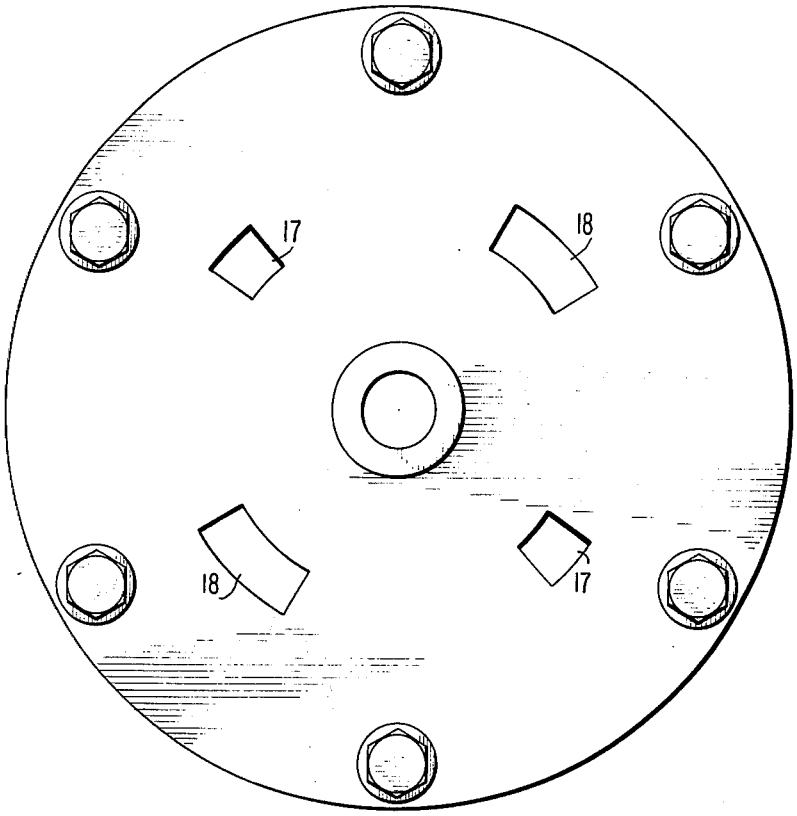
FIG.3
FIG.4
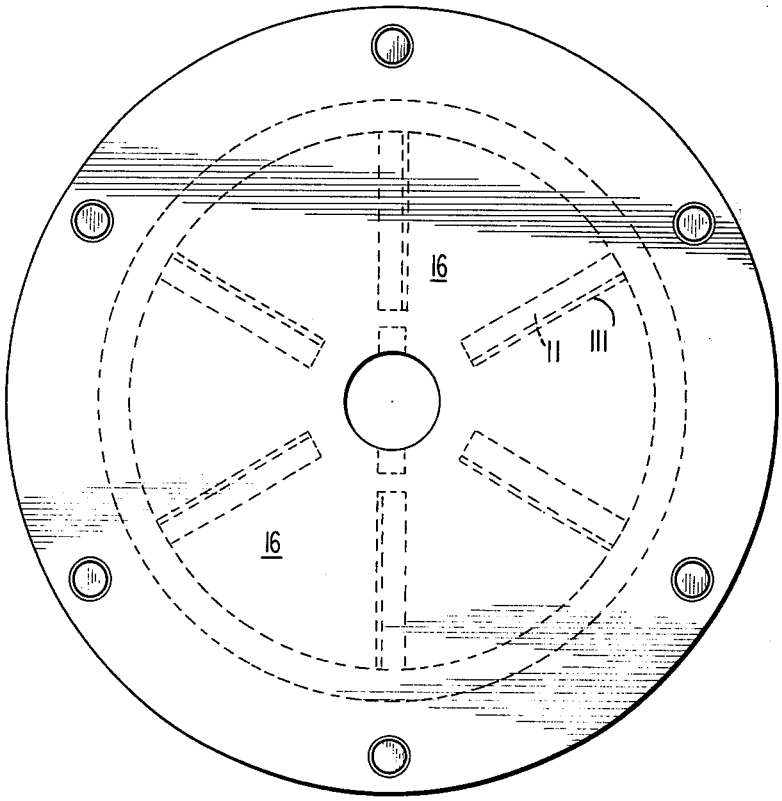

ROTARY FLUID PUMPS

BACKGROUND OF THE INVENTION

1. Field of the Invention

This invention is directed to the field of rotary fluid pumps.

2. Description of the Prior Art

Prior art rotary fluid pumps such as vacuum pumps and hydraulic pumps widely used generally comprise a cylindrical center housing 2 within which an eccentrically rotating rotor 4 provided with a plurality of vanes 3 movable up and down is encased, as shown in FIG. 1.

In these fluid pumps of this type, however, the rotor 4 is placed in a state of suction, at the time of pump suction of fluids, by the presence of negative pressure in an inlet chamber in cooperation with pressure on exhaust side.

Accordingly, the rotor 4 is one-sided and as a result, the shaft and bearing tend to receive an eccentric load.

For this reason, the shaft and bearing have their service life greatly shortened and many attempts have been made to improve the rotary fluid pump of this type.

SUMMARY OF THE INVENTION

This invention overcomes the limitations noted above with respect to prior art pumps and has as its object to provide an entirely novel rotary fluid pump which avoids occurrence of eccentric loads on the shaft and bearing.

A preferred embodiment of a rotary fluid pump in accordance with the present invention will now be described with reference to the accompanying drawings.

BRIEF DESCRIPTION OF THE DRAWINGS

FIG. 1 is a sectional view showing an embodiment of a well-known fluid pump;

FIG. 2 is a sectional view of a fluid pump in accordance with the present invention;

FIG. 3 is a left side view of the fluid pump in accordance with the present invention;

FIG. 4 is a right side view of the fluid pump in accordance with the present invention;

DESCRIPTION OF THE PREFERRED EMBODIMENT

Figure 5:
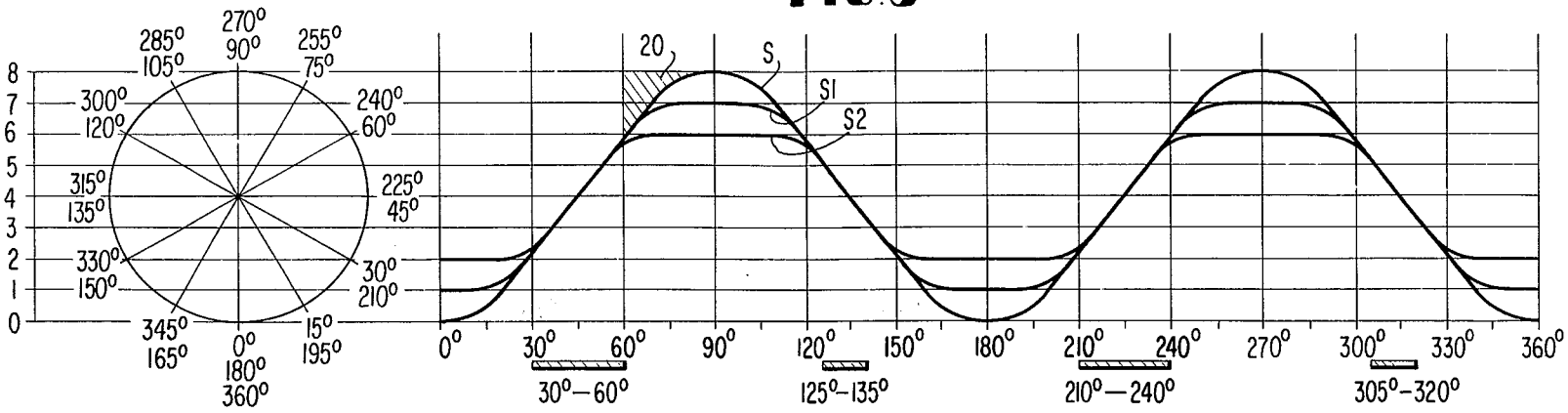
FIG. 5 is a development of a sine curve formed on the rear side housing side of the fluid pump in accordance with the present invention.
Figure 6:
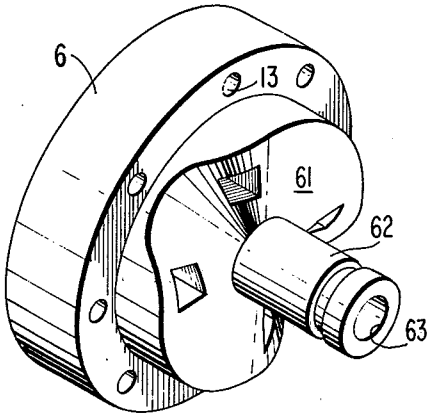
FIG. 6 is a perspective view of a rear side side-housing in the fluid pump in accordance with the present invention.

Referring now to FIG. 2, there is arranged a rear side side-housing or first annular plate 6 formed with an inner wall surface 61 in the form of a sine curve S or curves $S_1$ and $S_2$ analogous to the sine curve as shown in FIG. 5, an axial projecting reduced diameter portion 62 fitted in a circular recessed portion 72 formed in a rear side side-surface 71 of an annular rotor 7 which is bored and counterbored and a through hole or bore 63 which receives therein, a shaft 8 with the rotor 7 mounted thereon. A bearing support recess 63' is provided in the central portion of the arrangement, said bearing support recess 63' supporting a rear side side-housing 6 with a bearing 9 mounted thereon. An intermediate axial projecting portion 64 has a diameter approximately the same as the inner peripheral diameter of the center housing 5, said intermediate projecting portion 64 being fitted to the center housing at the rear side, side-surface 51. A through hole or bore 101 receives therein shaft 8 and a bearing support recess 101' is formed in the central portion of a front side, side-surface 52 of the front side housing 10. The front side side-housing or second annular plate 10 has a bearing 91 mounted within the bearing support recess 101'. Rotor 7 is fitted with a concave portion 102 having a diameter approximately the same as an outer peripheral diameter of the center housing 5.

The shaft 8 is inserted into the through holes or bores 63 and 101 in the rear and front side side-housings 6 and 10 so that the rotor 7 provided with annular recess 72 in the rear side side-surface 71 is mounted by means of a pin 81 on the shaft 8 within a cylindrical space formed by the aforesaid center housing 5, the rear side and front side side-housings 6 and 10 and the central axial projecting portion 62.

The rear side surface 71 of the rotor 7 is radially provided with a plurality of grooves 111 for holding seal members, and seal members 11 are retained in the grooves 111 through springs 12.

Bolt holes 13 are formed within the outer peripheral portions of the rear and front side, side-housings 6 and 10, and the rear side, side-housing 6 and the front side side-housing 10 are fastened and locked together by the use of bolt 14 within the holes 13.

In this case, a bearing support plate 15 may be used to fasten the housings and bolts 14 extend therethrough.

In FIG. 4, operating chambers 16, 16 . . . are formed by the rotor 7, the rear side side-housing 6, the center housing 5, and the plate-like seal members 11. Upon rotation of the rotor 7 driven by the saft 8, the seal members 11 advance and retreat along the sine curve undulating inner wall surface 61 to thereby gradually increase or gradually descrease the volume of the operating chambers 16.

An inlet port 17 (see FIG. 3) is formed in the rear side side-housing 6 in which the operating chmbers are incresed in volume, that is, the seal members 11 begin to advance, and an exhaust port 18 is formed at a location in which the operating chambers decrease in volume, that is, where the seal members 11 terminate their retreat.

Further, in order to maintain the operating chambers air-tight, an annular seal ring groove 74 is provided on the front side outer peripheral surface 73 of the rotor 7, and a seal ring 19 is mounted on the groove 74 so as to maintain air-tightness between the inner wall surface 53 of the center housing 5 and the outer peripheral surface 73 of the rotor 7, and a seal ring 191 is mounted within the outer peripheral surface 621 of the rear side side-housing 6 projection 62 to maintain air-tightness between the inner peripheral surface 75 of the rotor 7 and the rear side side-housing 6; thereby maintaining the operating chambers air-tight.

If the inner wall surface 61 of the rear side, side-housing follows sine curve S as shown in FIG. 5 a triangular space 20 is formed at the time of discharging fluids and accordingly, the fluids in the triangular space remain undischarged tp consequently not only reduce the exhaust effectiveness but also to compress the fluids in the aforesaid triangular space due to the movement of the seal member, thus exerting a force which impedes the turning effort of the rotor. For this reason, preferably the top of the sine curve may be flattened to remove the triangular space thereby curves $S_1$ and $S_2$ analogous to the sine curves may be employed in its stead.

While a preferred embodiment has been described, and wherein suction and exhaust is twice performed for every revolution of the rotor, it will be of course understood that the pump may be designed so that suction and exhaust may be performed once for every revolution of the rotor.

From the construction as previously described, the rotary fluid pump according to the present invention eliminates the need of eccentric rotation of the rotor with respect to the casing, and accordingly, the present invention provides a rotary fluid pump which can operate in a good condition for a long period of time without applying an eccentric load to the shaft and bearing.

In accordance with the present invention, a seal ring may be employed to hold the pump air-tight thus obtaining a better air-tightness. For this reason, the effective rotary fluid pump may be obtained.

From the construction as described above, the shaft will not be attracted toward the suction chamber so that the eccentric load is not loaded on the shaft and bearing to thereby provide a better operation for a long period of time.

What is claimed is:

1. A rotary fluid pump comprising:

a first annular plate forming a rear side, side-housing, a second annular plate forming a front side, side-housing, said rear side, side-housing having an inner wall surface facing said second annular plate provided with an axial projecting portion at the center thereof, a radially intermediate inner wall surface portion which undulates circumferentially in the form of a general sine curve, and an annular recess radially outwards thereof forming a first shoulder, said second annular plate being provided with an axial recess on the face thereof facing said first annular plate and forming a second shoulder, a cylindrical center housing extending between said annular plates and having portions received within said first and second shoulders, a plurality of bolts extending between said plates, radially outwards of said cylindrical center housing and fixing said first and second plates to said cylindrical center housing, axial bores formed within said first and second annular plates, portions of said first and second annular plates being counterbored, anti-friction bearings mounted within said counterbores, and a shaft extending through said bores and mounted by way of said bearings, said central axial projecting portion of said first annular plate extending axially beyond the circumferentially undulating inner wall surface portion of said first annular plate and terminating short of the inner wall surface of said second annular plate, an annular rotor having a bore receiving the portion of said shaft intermediate of the end of said first annular plate axial projecting portion and the inner wall of said second annular plate and being of an axial length in excess thereto and being counterbored, said counterbore receiving the central axial projecting portion of said second annular plate and being rotatable thereon, said rotor further being provided with a plurality of circumferentially spaced radial grooves opening axially towards said sine curve, inner wall surface, plate-like seal members slidably positioned within said grooves with their edges spring biased into contact with said sine curve inner wall surface, and at least one inlet and exhaust port formed within said rear side, side-housing at circumferentially positions;

whereby, operating chambers formed by the rotor, said first and second annular plates and said center housing and said plate-like seal members sequentially increase and decrease in volume during rotation of the rotor and pumping forces exerted through said rotor on said shaft and said bearing within said annular plate are equally distributed on said shaft and said bearings within said first and second annular plates.

2. The rotary fluid pump as claimed in claim 1, wherein said axially projecting portion of said first annular plate includes an annular groove within the periphery of the same facing the counterbore portion of said rotor, and the outer periphery of said annular rotor includes an annular groove intermediate of its end faces facing the inner wall of said cylindrical center housing, and sealing rings are mounted within respective grooves to prevent fluid leaking along the surfaces of said rotor during rotation thereof with respect to said first annular plate and said cylindrical center housing.

* * * * *